US005897391A

United States Patent [19]

Takahashi et al.

[11] Patent Number: 5,897,391

[45] Date of Patent: Apr. 27, 1999

[54] LAMP SOCKET

[75] Inventors: Tetsuya Takahashi; Kensaku Sato, both of Tokyo, Japan

[73] Assignee: Hirose Electric Co.,Ltd., Tokyo, Japan

[21] Appl. No.: 08/896,058

[22] Filed: Jul. 17, 1997

[30] Foreign Application Priority Data

Aug. 2, 1996 [JP] Japan ..... 8-219137

[51] Int. Cl.[6] ..... H01R 4/50

[52] U.S. Cl. ..... 439/336; 439/489

[58] Field of Search ..... 439/188, 488, 439/489, 490, 336, 611–619

[56] References Cited

U.S. PATENT DOCUMENTS 5,380,214 1/1995 Ortega, Jr. ..... 439/253
5,411,411 5/1995 Ogawa et al. ..... 439/336
5,590,952 1/1997 Cheng et al. ..... 439/340 X
5,595,493 1/1997 Chen ..... 439/188

FOREIGN PATENT DOCUMENTS 0526335 2/1993 European Pat. Off. .
0586308 3/1994 European Pat. Off. .
0709936 5/1996 European Pat. Off. .
0818856 1/1998 European Pat. Off. .

*Primary Examiner*—Khiem Nguyen
*Attorney, Agent, or Firm*—Kanesaka & Takeuchi

[57] ABSTRACT

A central terminal (40) is provided in the central mount (9) of the plugging cavity (4) for contact with the plug terminal (85) of the lamp plug (B). An outer terminal (50) and a check terminal (70) are provided in the outer mount (10A) and the check mount (10B), respectively, for contact with the annular contact (88) on the side wall of the lamp plug (B).

2 Claims, 11 Drawing Sheets

LAMP SOCKET

BACKGROUND OF THE INVENTION

1. Field of the Invention

The present invention relates to lamp sockets for receiving lamps such as automobile headlights.

2. Description of the Related Art

Some lamps, such as automobile headlights, are as bright as daylight. Such an automobile headlight includes a lamp socket and lamp plug. The lamp socket includes a plugging section, a central mount at the center of the plugging section, and an outer mount at the periphery of the plugging section.

A central terminal and an outer terminal are provided at the central and the outer mounts, respectively, for contact with a plug terminal and a peripheral contact when the lamp plug is plugged in the lamp socket.

When the lamp plug is plugged in the lamp socket, the central terminal and the outer terminals are brought into contact with the plug terminal and the peripheral contact, respectively.

However, there is no means to determined if the lamp plug is plugged in the lamp socket so that it is frequent to apply voltage to the lamp socket without the lamp plug attached. Consequently, a spark is produced across the central terminal and the outer terminal, causing damage to the equipment.

SUMMARY OF THE INVENTION

Accordingly, it is an object of the invention to provide a lamp socket which is able to determine if a lamp plug is plugged in the lamp socket to prevent the application of a voltage to the lamp socket with no lamp plug attached and the generation of a spark across the central terminal and the outer terminal.

According to the invention there is provided a lamp socket which includes a socket body having a plugging cavity with a side wall; a central mount provided in said plugging cavity; a central terminal provided in said central mount for contact with a plug terminal when a lamp plug is plugged in said lamp socket; an outer mount provided in said side wall of said plugging cavity; an outer terminal provided in said outer mount for contact with a circumferential contact of said lamp plug; and a plugging detector provided in said socket body for detecting if said lamp plug is plugged in said lamp socket.

When the lamp plug is plugged in the lamp socket, the central and outer terminals are brought into contact with the plug terminal and the circumferential contact of the lamp plug, respectively, and the plugging detector detects the plugging of the lamp plug in the lamp socket. In this way, whether the lamp plug is plugged in the lamp socket is determined. Consequently, it is possible to prevent the application of a voltage to the lamp socket with no lamp plug attached and damage to the equipment by a spark generated between the central and outer terminals.

BRIEF DESCRIPTION OF THE DRAWINGS

FIG. 7(2) is a side view as viewed from an arrow F of FIG. 7(1);

FIG. 7(3) is a front view of a terminal leg portion of the terminal;

FIG. 8(2) is a side view as viewed from an arrow G of the FIG. 8(1);

FIG. 8(3) is a bottom view of the terminal;

FIG. 8(4) is a sectional view taken along line 8—8 of FIG. 8(3);

FIG. 9(2) is a side view of the check terminal;

FIG. 12(2) is a bottom view of the lamp plug; and

DESCRIPTION OF THE PREFERRED EMBODIMENT

Figure 1:
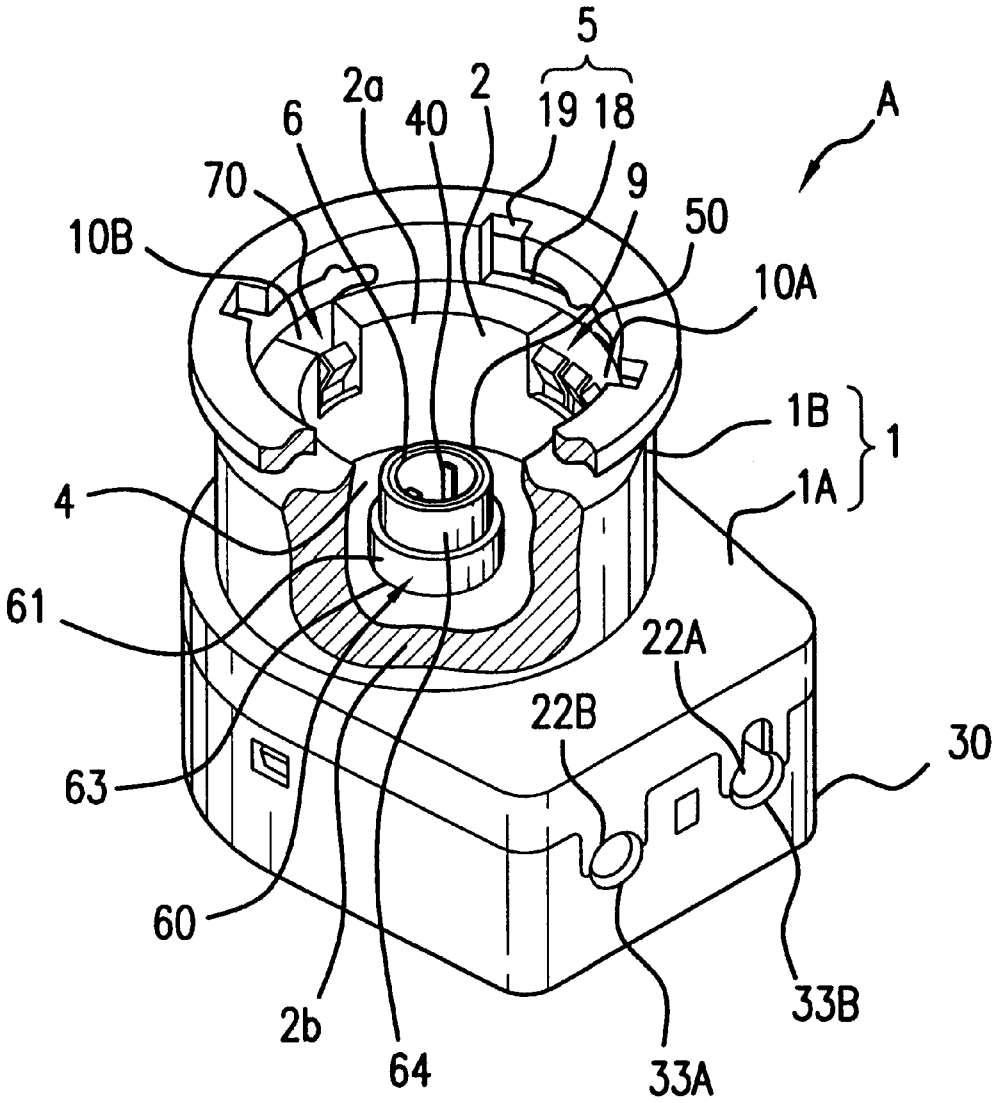
FIG. 1 is a partially cutaway perspective view of a lamp socket according to an embodiment of the invention.

In FIG. 1, a lamp socket A includes a socket body 1, a cover 30, a central terminal 40 at the center of the socket body 1, an outer terminal 50 at the periphery of the socket body 1, an insulation seal member 60, and a check terminal 70 at the periphery of the socket body 1.

In FIGS. 1–6, the socket body 1 includes a base section 1A having a front-square, rear-circular form and a plugging section 1B having a cylindrical form with a plugging space 2 therein. In the plugging space 2 there are provided a central mount 9 having a tubular portion 6 at the center, a plugging cavity 4, and an engaging portion 5.

Figure 5:
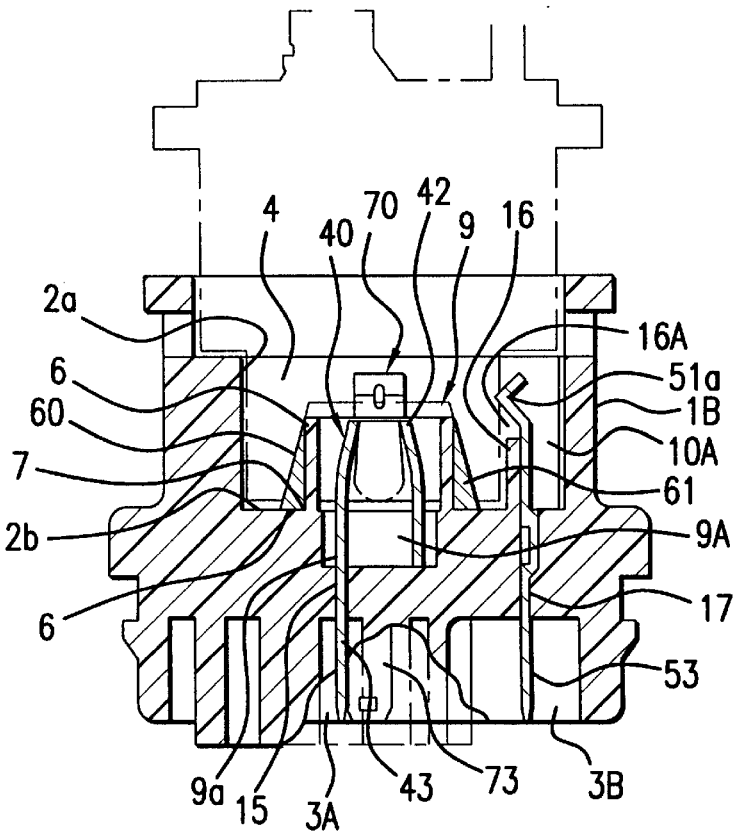
FIG. 5 is a sectional view taken along line 5—5 of FIG. 3.

In FIG. 5, the plugging cavity 4 has an annular form defined by the tubular portion 6 of the central mount 9 and an inner surface 2*a* of the plugging space 2. An outer surface of the tubular portion 6 from the top of the tubular portion 6 to the bottom surface 2*b* of the plugging space 2 forms an insulation seal mounting portion 7. A mounting recess 9A is provided in the central mount 9, and an outer mount 10A and a check terminal mount 10B are provided in the side wall of the plugging cavity 4.

A terminal aperture 15 is provided in the bottom of the plugging recess 9A close to a side wall 9*a* of the plugging recess 9A so as to communicate with a central outlet 3A provided in the base section 1A. A partition wall 16 is provided to separate the outer mount 10A from the plugging cavity 4, and a terminal window 16A is provided above the partition wall 16. A terminal aperture 17 communicates with an outer outlet 3B provided on the back of the base section 1A.

Figure 6:
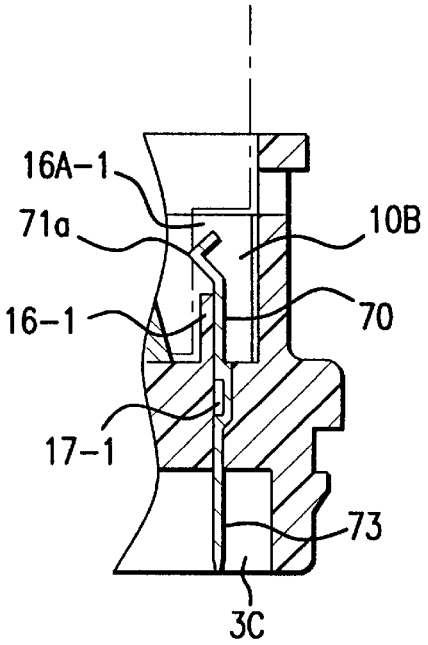
FIG. 6 is a sectional view taken along line 6—6 of FIG. 3.

In FIGS. 1 and 6, a partition wall 16-1 is provided to separate the check mount 10B from the plugging cavity 4, and a terminal window 16A-1 is provided above the partition wall 16-1. A terminal aperture 17-1 communicates with an terminal outlet 3C provided on the back of the base section 1A. The engaging portions 5 consist of an engaging groove 18 provided in the side wall of the plugging space 2 and an insertion groove 19 communicates with the engaging groove 18.

Figure 2:
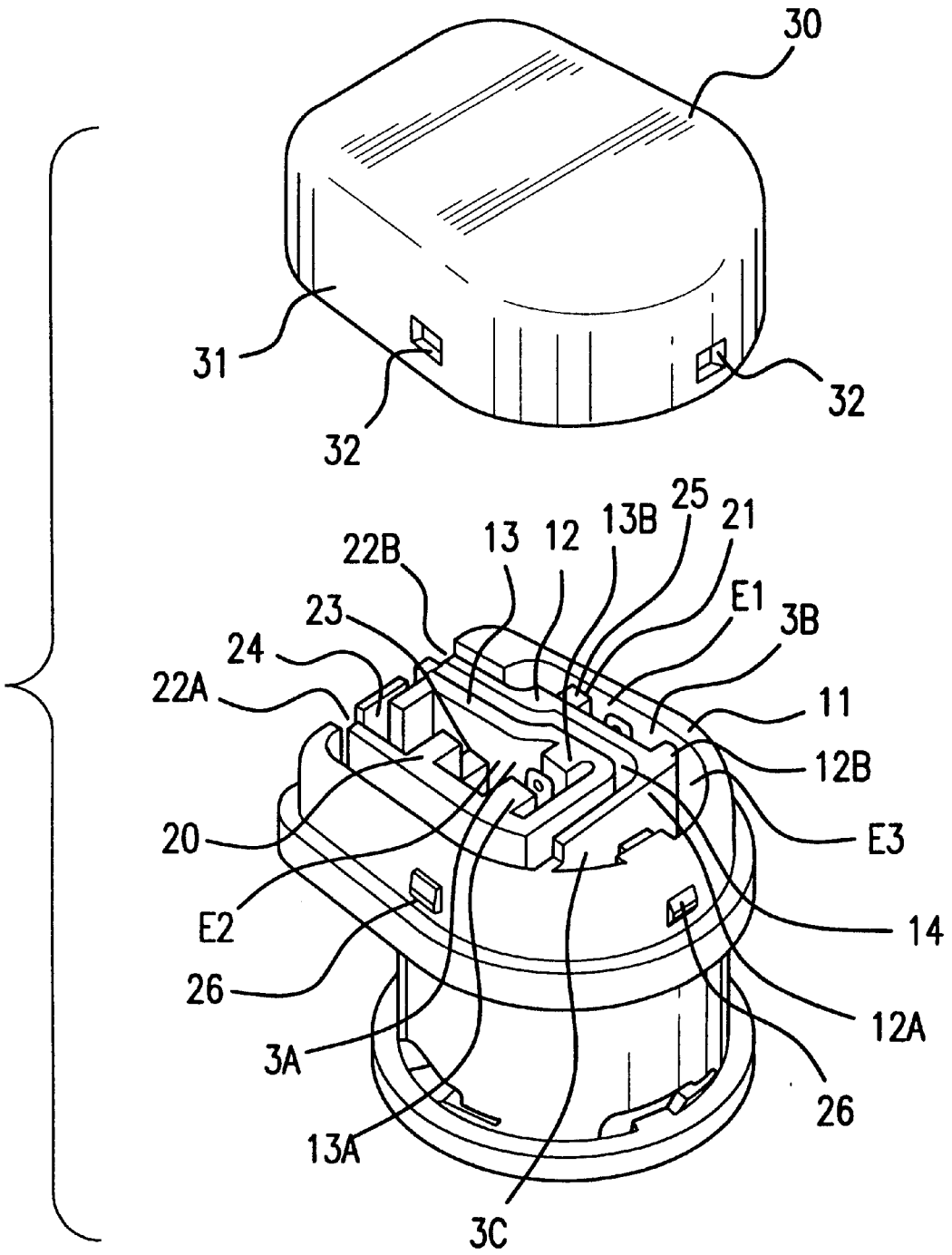
FIG. 2 is an exploded perspective view of the lamp socket as viewed from the back.
Figure 3:
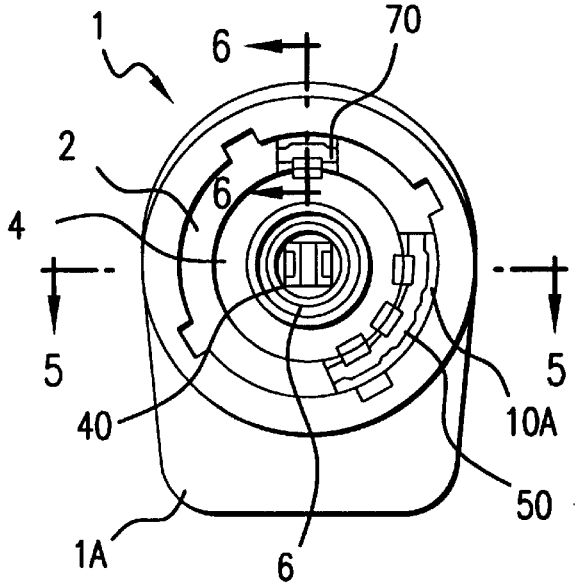
FIG. 3 is a plan view of the lamp socket, with the cover removed.
Figure 4:
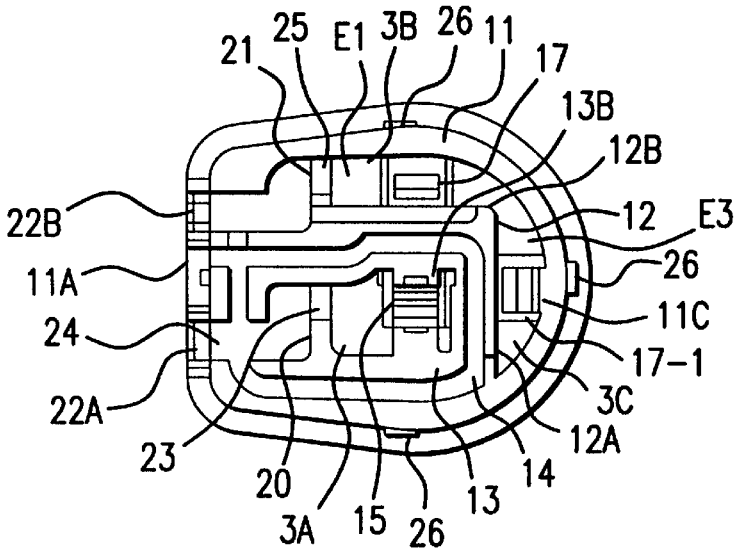
FIG. 4 is a bottom view of the lamp socket, with the cover removed.

In FIGS. 2 and 4, a plugging wall 11 having the same front-square, rear-circular form as the base section 1A is provided on the back of the base section 1A. A partition wall 12 is provided to divide the area within the plugging wall 11 into three areas; i.e., left, right, and rear areas E1, E2, and E3, respectively. A seal groove forming wall 13 is provided in the right area E2 with a predetermined distance from the plugging wall 11 and the partition wall 12 to form a loop-like seal groove 14.

A partition wall 20 is provided in the right area E2 to extend inwardly from the seal groove forming wall 13 in a second direction perpendicular to the first or longitudinal direction of the socket to define the terminal outlet 3A along with the seal groove forming wall 13. A pair of protruded walls 13A and 13B extend toward each other from the seal groove forming wall 13 in the second direction, and the terminal aperture 15 has an opening between the protruded walls 13A and 13B.

A partition wall 21 is provided in the left area E1 in the second direction to define the terminal outlet 3B along with the plugging wall 11 and the partition wall 12. The rear area E3 has the terminal outlet 3C wherein a protruded wall 11C is provided in the longitudinal direction. The terminal aperture 17-1 has an opening between a lateral wall 12A of the partition wall 12 and the protruded wall 11C.

A pair of cable outlets 22A and 22B are provided in an end section 11A of the plugging wall 11. The cable outlet 22A communicates with the terminal outlet 3A via notches 23 and 24 provided in the partition wall 20 and the seal groove forming wall 13, respectively. The cable outlet 22B communicates with the outer outlet 3B via a notch 25 in the partition wall 21. Also, it communicates with the terminal outlet 3C via the notch 25, a corner 12B of a lateral section 12A of the partition wall 12. A plurality of engaging projections 26 are provided on the periphery of the plugging wall 11.

The cover 30 fits in the base section 1A of the socket 1. As FIGS. 1 and 2 show, the circumferential wall 31 has a front-square, rear-circular shape. A plurality of engaging apertures 32 are provided in the circumferential wall 31. A pair of cable outlets 33A and 33*b* are provided in an end section of the circumferential wall 31. A loop-like seal press (not shown) is provided on an inside of the cover 30 for insertion into the seal groove 14 in the back of the base section 1A.

Figure 7:
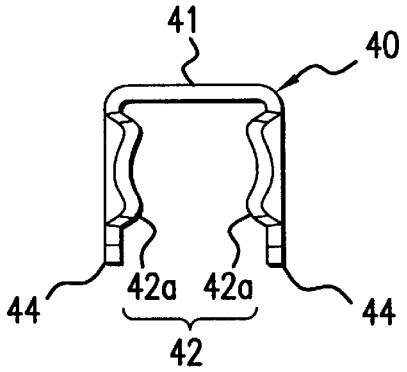
FIG. 7(1) is a plan view of a central terminal.
Figure 7:
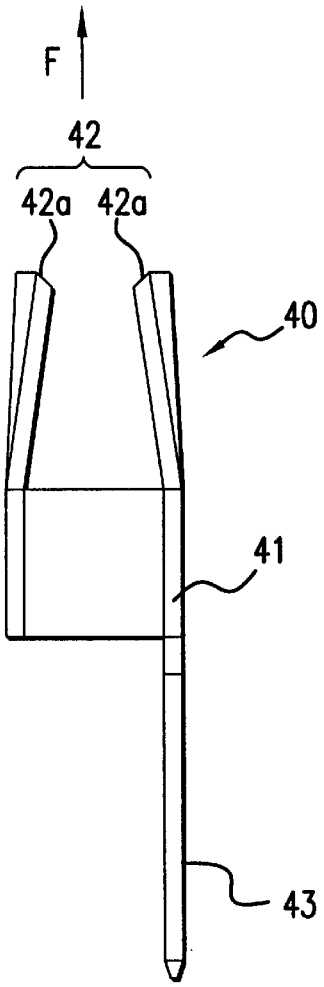
Figure 7:
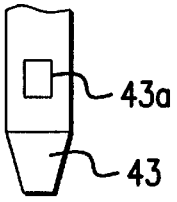

In FIGS. 7(l)–(3), the central terminal 40 includes a press fitting section 41 having a C-shaped cross-section, a contact section 42 consisting of a pair of opposed contact pieces 42*a* extending upward from the press fitting section 41, and a leg section 43 extending downward from the press fitting section 41, with a pair of engaging portions 44 provided at free ends of the press fitting section 41. An engaging aperture 43*a* is provided in the leg section 43.

In FIGS. 8(l)–(4), the outer terminal 50 includes a linking section 52, three contact sections 51 extending upward from the linking section 52 and having a contact point 51*a*, and a leg section 53 extending downward from the linking section 52 and having an engaging aperture 53*a*. The insulation seal member 60 is made from an insulation material, such as urethane gum. As FIGS. 1 and 5 show, it includes a tubular seal body 61 having a seat face 63 at the bottom and a stepped-down head portion 64.

In FIGS. 9(l)–(2), the check terminal 70 includes a terminal section 71 having a contact tip 71*a* and a leg section 73 extending downward from the terminal section 71. The central terminal 40 is attached by fitting the fitting portion 41 into the mount recess 9A at the central mount 9 of the socket body 1 such that the contact portion 42 of the central terminal 40 is located at the tubular portion 6 while the terminal leg 43 projects into the terminal outlet 3A via the terminal aperture 15.

The outer terminal 50 is fitted into the terminal mount 10A of the socket body 1 such that the contact point 51*a* of the outer terminal 50 is exposed in the plugging cavity 4 at the terminal window 16A while the terminal leg 53 of the outer terminal 50 projects into the terminal outlet 3B via the terminal aperture 17. The check terminal 70 is fitted in the terminal mount 10B of the socket body 1 such that the contact point 71*a* of the check terminal 70 is exposed in the plugging cavity 4 at the terminal window 16A-1 while the terminal leg 73 of the check terminal 70 projects into the terminal outlet 3C via the terminal aperture 17-1. The outer terminal 50 and the check terminal 70 is exposed so much that the contact points 51*a* and 71*a* contact the contact portion 88 of the fitting section 81 of a lamp plug B.

The insulation seal member 60 is fitted over the tubular portion 6 such that the seat portion 63 of the seal body 61 abuts on the bottom face 2*b* of the fitting recess 2 while the inside surface of the seal body 61 abuts on the outer surface of the tubular section 6. The seal member 60 is inserted in the seal groove 14 in the back of the base section 1A of the socket body 1.

Figure 10:
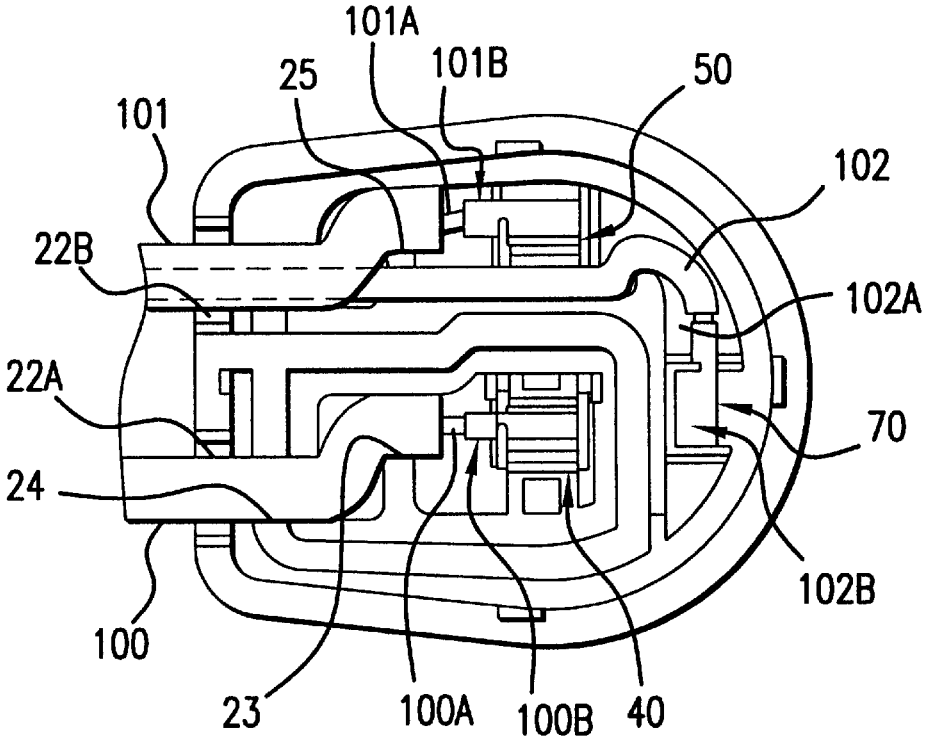
FIG. 10 is a bottom view of the lamp socket with wires.
Figure 11:
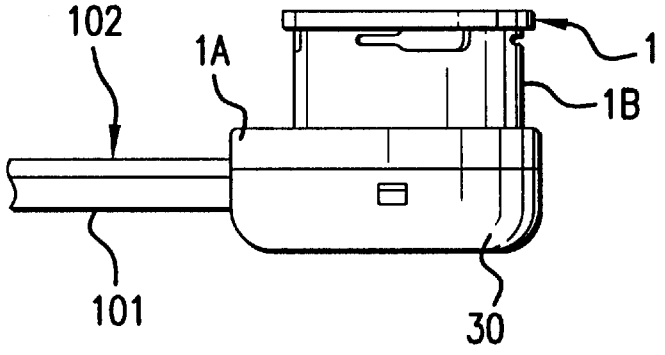
FIG. 11 is a side view of the lamp socket with the cover.

In FIG. 10, the core wire 100A of a high-voltage cable 100 is connected to the terminal leg 43 of the central terminal 40 via a connection member 100B. The high-voltage cable 100 goes outside at a cable outlet 22A via the cutouts 23 and 24. The core wire 101A of a ground cable 101 is connected to the terminal leg 53 of the outer terminal 50 via a connection member 101B, and the ground cable 101 is led outside at the cable outlet 22B via the cutout 25. The core wire 102A of the check (ground) cable 102 is connected to the terminal leg 71 of the check terminal 70 via a connection member 102B, and the check cable 102 is led out along the ground cable 101 at the cable outlet 22B via the cutout 25.

The cover 30 is attached to the base section 1A such that the side wall 31 is fitted over the fitting wall 11 of the base section 1A while the engaging apertures 32 engage the engaging projects 26. Consequently, the cable outlets 22A, 22B, 33A, 33B of the socket body 1 and the cover 30 are brought together, and the cables 100, 101, and 102 are led out of these outlets 22A, 22B, 33A, and 33B. The seal pressure 34 of the cover 30 is inserted in the seal groove 14 so as to press the seal member so that there is no space communicating between the terminal outlets 3A and 3B, thus providing almost perfect insulation and separation.

Figure 12:
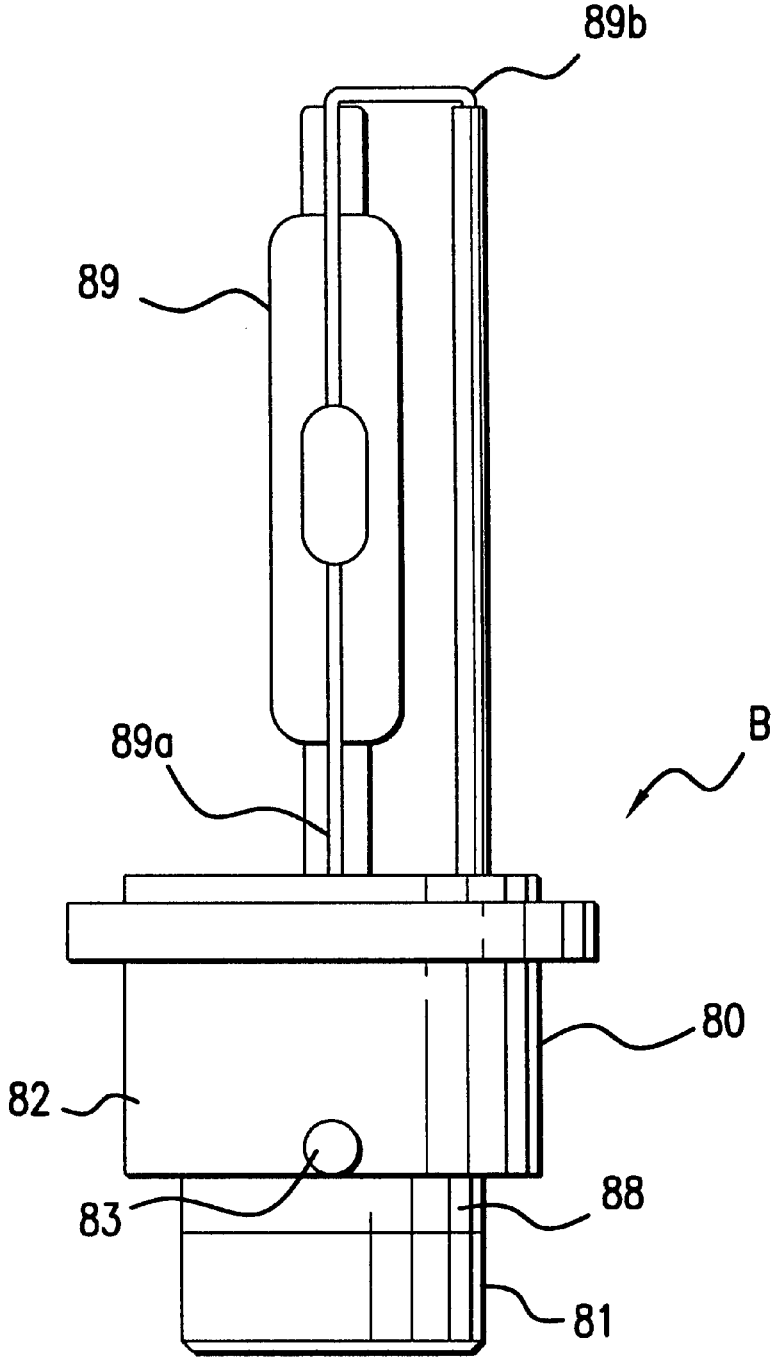
FIG. 12(1) is a side view of a lamp plug.
Figure 12:
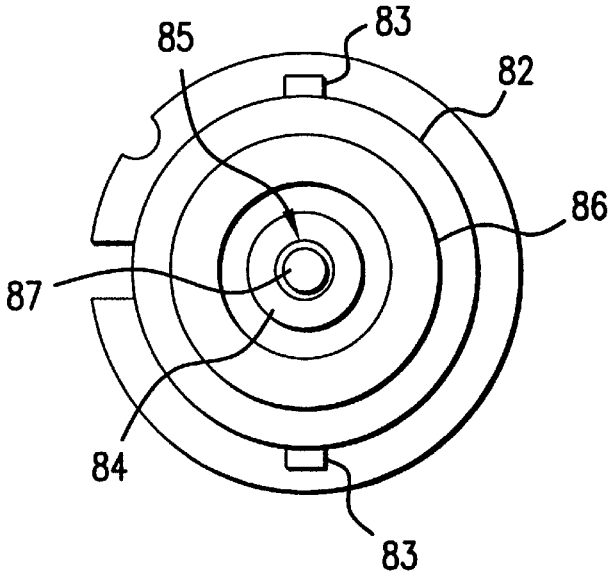

In FIG. 12, the lamp plug B includes a lamp plug body 80 which consists of a plugging section 81 to be fitted in the plugging cavity 4 of the lamp socket A and an engaging section 82 to engage the engaging section of the lamp socket A. An engaging pin 83 is provided on the engaging section 82. A circular recess 84 is provided in the end face of the plugging section 81.

A plug terminal 85 is mounted at the center of the plug body 80 such that a contact portion 87 of the plug terminal 85 projects into the circular recess 84. An annular or circumferential contact 88 is provided around the plugging section 81. A bulb 89 is plugged in a plug connection section (not shown) of the plug terminal 85 such that a contact point 89*a* of the bulb 89 is connected to the plug terminal 85 while the other contact point 89 is connected to the annular contact 88.

The plugging section of the lamp plug B is fitted in the plugging cavity 4 of the lamp socket A by inserting the engaging pin 83 of the engaging section 82 into the insertion groove 19 and then rotating the lamp plug B so that the engaging pin 83 engages the engaging aperture 18. Consequently, the contact portion 87 of the plug terminal 85 is brought into contact with the contact portion 42*a* of the central terminal 40 while the annular contact 88 of the plugging section 81 is brought into contact with the contact points 51*a* and 71*a* of the outer terminal 50 and the check terminal 70, respectively.

A plugging detector is made up of the check terminal mount 10B provided on the side wall of the plugging cavity 4 along with the outer mount 10A, and the check terminal 70 provided in the terminal mount 10B for contact with the annular contact 88 of the lamp plug B. When the lamp plug B is plugged in the lamp socket A, the outer terminal 50 and the check terminal 70 are brought into contact with the contact portion 88 on the periphery of the lamp plug B to make a short circuit between the outer terminal 50 and the check terminal 70 so that it is possible to determine if the lamp plug B is plugged in the lamp socket A by detecting the short circuit.

Figure 8:
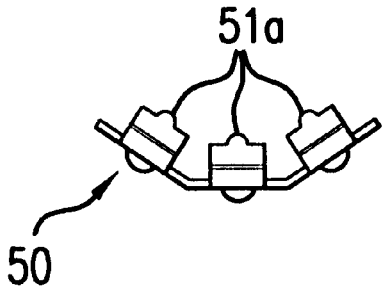
FIG. 8(1) is a plan view of an outer terminal.
Figure 8:
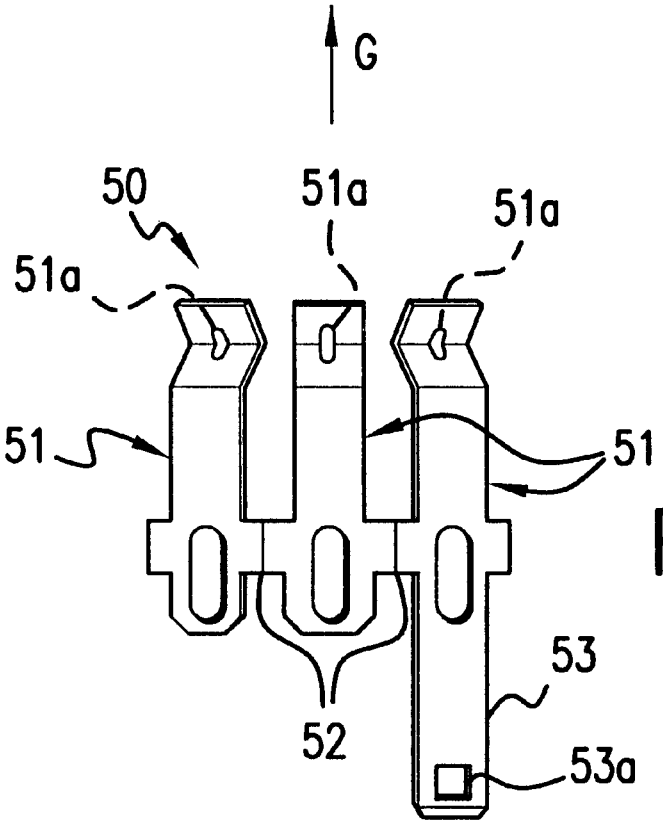
Figure 8:
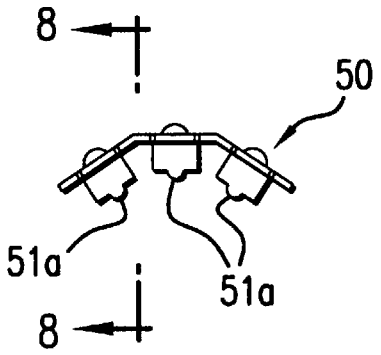
Figure 8:
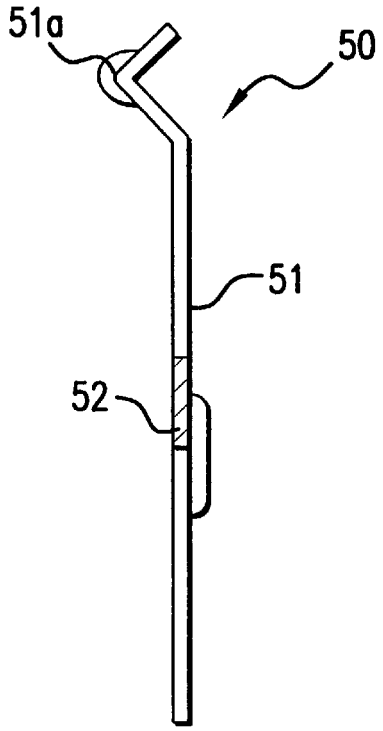
Figure 9:
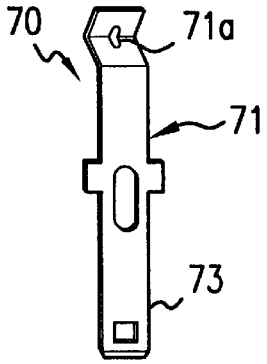
FIG. 9(1) is a perspective view of a check terminal.
Figure 9:
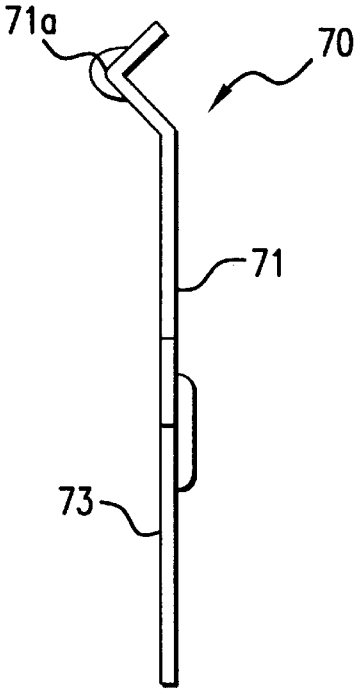
Figure 13:
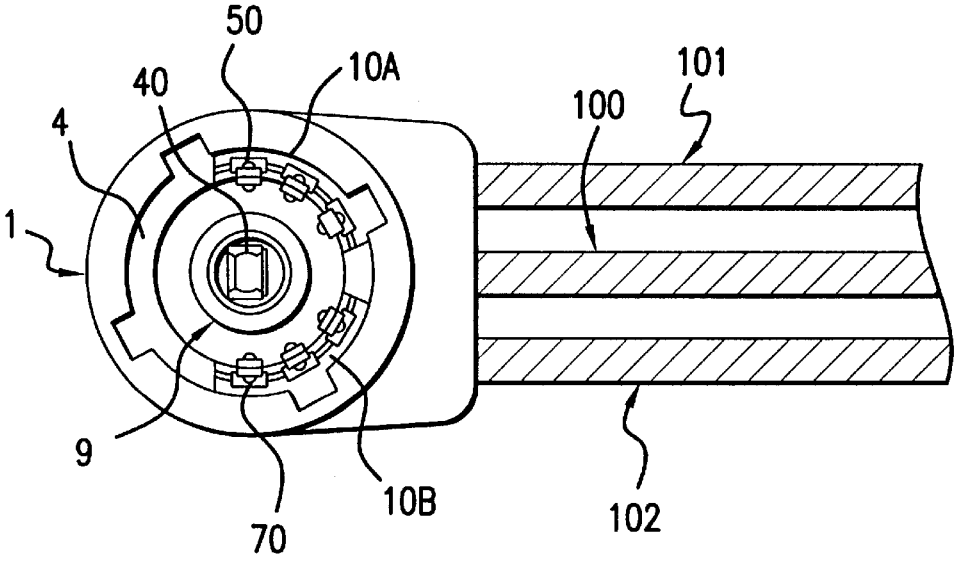
FIG. 13 is a bottom view of a lamp socket, with the cover removed, according to another embodiment of the invention.

As a result, it is possible to prevent the application of a voltage if the lamp plug B is not plugged in the lamp socket A and damage to the equipment by a spark across the central terminal 40 and the outer terminal 50. Alternatively, the check terminal 70 such as shown in FIGS. 9(1) and (2) may be made similarly to the outer terminal 50 as shown in FIG. 8. As FIG. 13 shows, the check terminal 70 is attached to the socket body 1 in the terminal mount 10B provided in the side wall of the plugging cavity 4 in the same way as the outer terminal 50 attached to the socket body 1. In this case there is provided better contact between the annular contact 88 of the lamp plug B and the check terminal 70.

According to one aspect of the invention, the lamp socket includes the central terminal provided in the central mount of the plugging section for contact with the plug terminal, the outer terminal provided in the outer mount, and a plugging detector provided in the socket body for detecting the plugging of the lamp plug in the lamp socket to determine if the lamp plug is plugged in the lamp socket.

As a result, the application of a voltage to the lamp socket with no lamp plug attached is prevented, and damage to the equipment by a spark across the central and outer terminals is prevented.

According to another aspect of the invention, the plugging detector includes the terminal mount provided in the peripheral wall of the fitting section and the check terminal provided in the terminal mount along with the outer terminal so that when the lamp plug is plugged in the lamp socket, the central terminal and the outer and check terminals are brought into contact with the plug terminal and the annular contact, respectively. Consequently, the outer and check terminals make a short circuit, which is detected to determined if the lamp plug is plugged in the lamp socket. Accordingly, the application of a voltage to the lamp socket with no lamp plug attached is prevented, and damage to the equipment by a spark between the central and outer terminals is prevented.

According to still another aspect of the invention, the check terminal has a plurality of contact points for contact with the annular contact of the lamp plug to provide better contact between the check terminal and the annular contact.

What is claimed is:

1. A lamp socket comprising:

a socket body having a plugging cavity with a side wall;

a central mount provided in said plugging cavity;

a central terminal provided in said central mount for contact with a plug terminal when a lamp plug is plugged in said lamp socket;

an outer mount provided in said side wall of said plugging cavity;

an outer terminal having a plurality of contact points provided in said outer mount for contact with a circumferential contact of said lamp plug;

a check mount provided in said side wall of said plugging cavity along with said outer mount; and a check terminal for contact with said circumferential contact provided in said check mount and insulated from said outer terminal for detecting if said lamp plug is plugged in said lamp socket by detecting a short circuit between said check terminal and said outer terminal.

2. A lamp socket according to claim 1, wherein said check terminal has a plurality of contact points for contact with said circumferential contact.

* * * * *